US008042495B2

(12) United States Patent
Min

(10) Patent No.: US 8,042,495 B2
(45) Date of Patent: Oct. 25, 2011

(54) DEVICE FOR PREVENTING INITIAL HOT WATER SUPPLYING IN CONCENTRIC TUBE TYPE HEAT EXCHANGER AND ITS CONTROL METHOD

(75) Inventor: Tae-Sik Min, Dongjak-gu (KR)

(73) Assignee: Kyungdong Everon Co., Ltd., Chungcheongbuk-do (KR)

( * ) Notice: Subject to any disclaimer, the term of this patent is extended or adjusted under 35 U.S.C. 154(b) by 617 days.

(21) Appl. No.: 12/085,113

(22) PCT Filed: Mar. 10, 2006

(86) PCT No.: PCT/KR2006/000859

§ 371 (c)(1),
(2), (4) Date: May 16, 2008

(87) PCT Pub. No.: WO2007/058411

PCT Pub. Date: May 24, 2007

(65) Prior Publication Data

US 2009/0133641 A1 May 28, 2009

(30) Foreign Application Priority Data

Nov. 19, 2005 (KR) ..... 10-2005-0111016

(51) Int. Cl.
*F24H 1/22* (2006.01)

(52) U.S. Cl. ..... 122/18.1; 122/406.1; 237/19; 165/154; 165/156

(58) Field of Classification Search ..... 122/18.1, 122/14.22, 406.1; 237/8 R, 8 C, 19; 126/350.1; 165/154, 156
See application file for complete search history.

(56) References Cited

U.S. PATENT DOCUMENTS

| | | | | |
|---|---|---|---|---|
| 3,647,136 | A * | 3/1972 | Meier | 237/8 R |
| 3,896,992 | A * | 7/1975 | Borovina et al. | 237/19 |
| 6,606,968 | B2 * | 8/2003 | Iwama et al. | 122/18.1 |
| 6,694,927 | B1 * | 2/2004 | Pouchak et al. | 122/448.1 |
| 7,597,066 | B2 * | 10/2009 | Shimada et al. | 122/18.1 |
| 7,773,868 | B2 * | 8/2010 | Moore | 392/490 |
| 2002/0148415 | A1 * | 10/2002 | Manley et al. | 122/40 |
| 2009/0159017 | A1 * | 6/2009 | Tsuge | 122/14.1 |

FOREIGN PATENT DOCUMENTS

| | | |
|---|---|---|
| JP | 9-303872 | 11/1997 |
| JP | 10-89770 | 4/1998 |
| KR | 10-1995-0011995 | 5/1995 |

(Continued)

OTHER PUBLICATIONS

International Search Report for Application No. PCT/KR2006/000859, dated Aug. 14, 2006.

*Primary Examiner* — Gregory A Wilson
(74) *Attorney, Agent, or Firm* — Nelson Mullins Riley & Scarborough LLP; Anthony A. Laurentano

(57) ABSTRACT

A device for preventing initial hot water from being discharged from a double pipe heat exchanger and a method of controlling the same, which can temporarily mix cold water with hot water so as to decrease the temperature of the discharged hot water when the high temperature water is initially discharged from the double pipe heat exchanger.

3 Claims, 2 Drawing Sheets

FOREIGN PATENT DOCUMENTS

| | | |
|---|---|---|
| KR | 10-1997-0070823 | 11/1997 |
| KR | 1998-086000 | 12/1998 |
| KR | 1999-021378 | 3/1999 |
| KR | 10-2003-0097212 | 12/2003 |
| KR | 10-2004-0106651 | 12/2004 |
| KR | 10-2005-0043438 | 5/2005 |
| KR | 10-2005-0043439 | 5/2005 |

* cited by examiner

[Fig. 1]
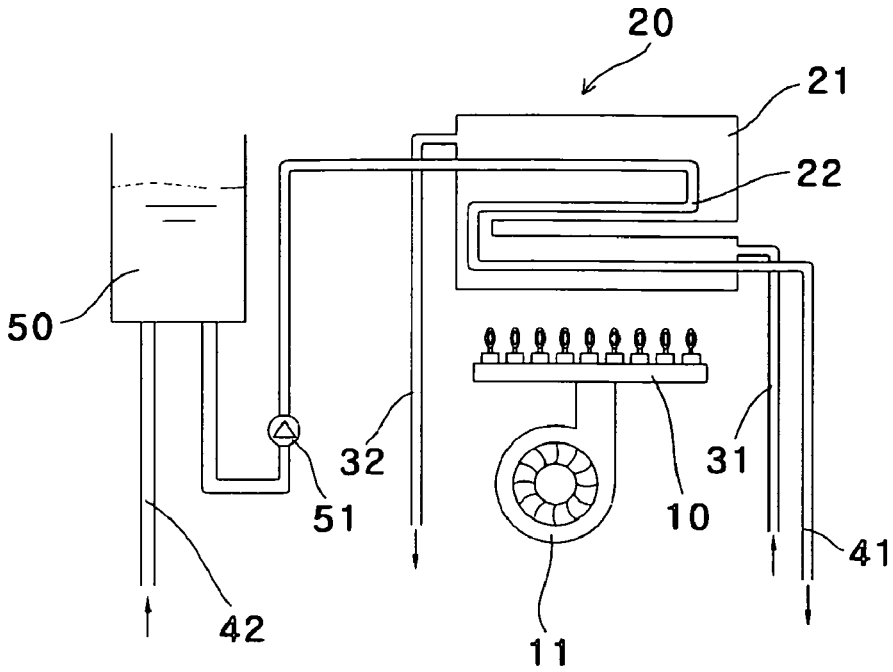
[Fig. 2]
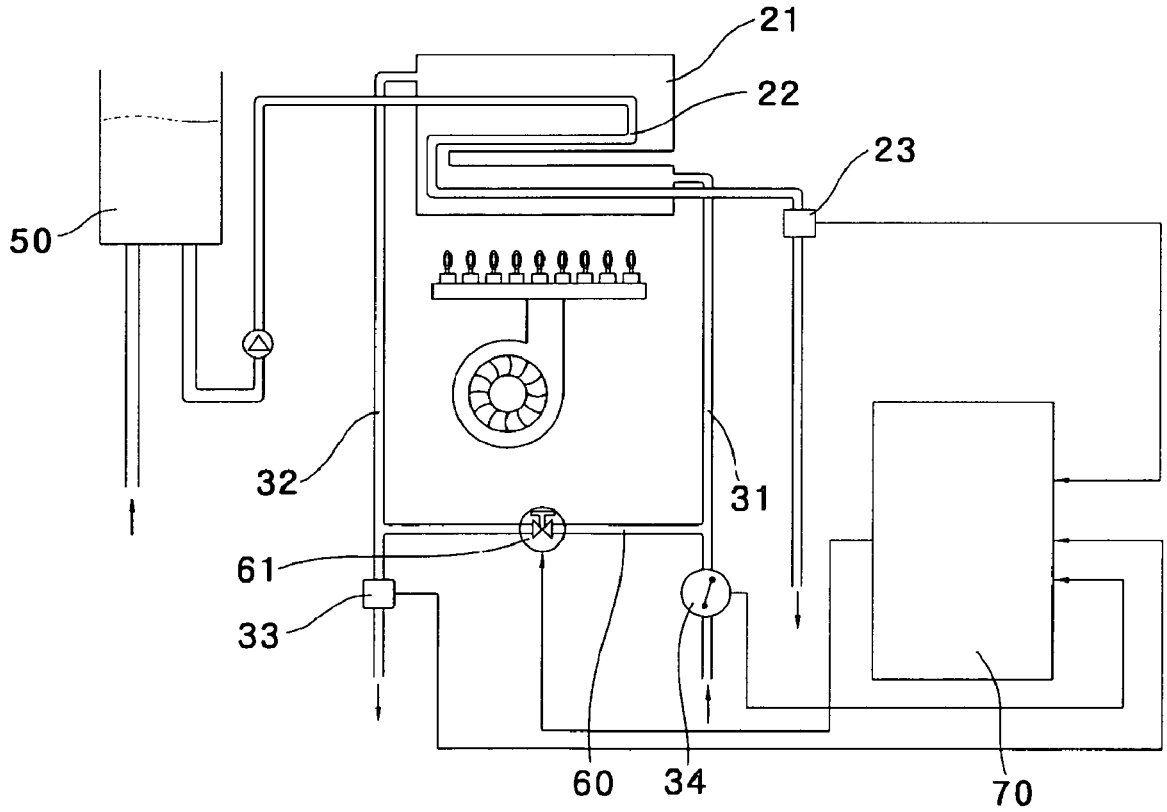

[Fig. 3]
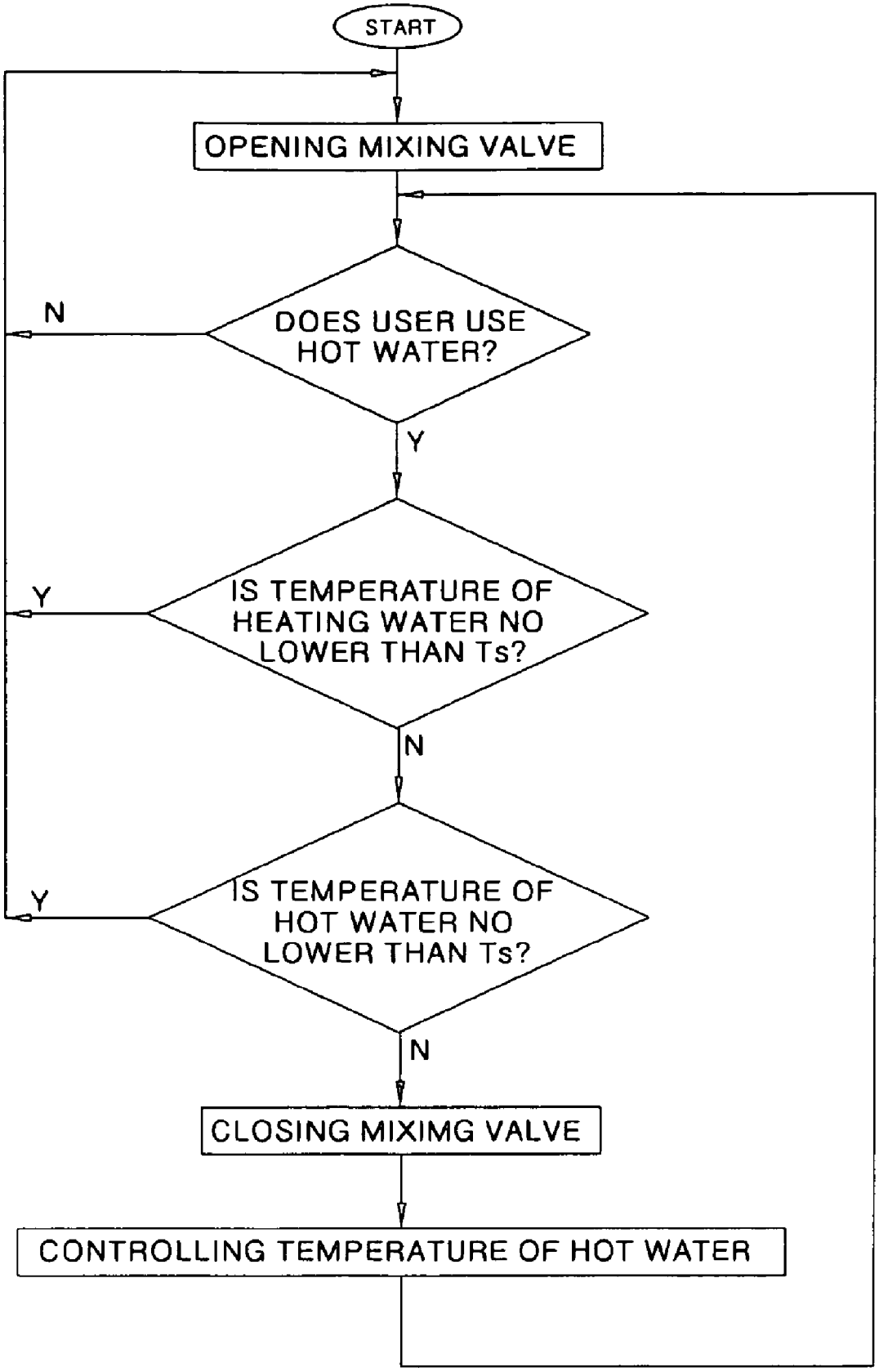

DEVICE FOR PREVENTING INITIAL HOT WATER SUPPLYING IN CONCENTRIC TUBE TYPE HEAT EXCHANGER AND ITS CONTROL METHOD

TECHNICAL FIELD

The present invention relates to a device for preventing initial hot water supplying in a concentric tube type heat exchanger and a method for controlling the same, and more particularly to a device for preventing initial hot water supplying in a concentric tube type heat exchanger and a method for controlling the same, which can mix a cold water with hot water at initial time when the hot water is supplied, so as to decrease a temperature of the supplied hot water, thereby preventing scald.

BACKGROUND ART

Generally, heat exchangers refer to devices transferring heat from high temperature fluid to low temperature fluid through a heating wall, using a heat medium for heat transfer. The heat exchangers can be classified into a water injection type heat exchanger, a double pipe type heat exchanger, a finned tube heat exchanger, and a shell and tube type heat exchanger according to their structure. The double pipe type heat exchanger includes an inner pipe and an outer pipe, in which heat is exchanged between fluid in the inner pipe and fluid between the inner pipe and the outer pipe. Such a double pipe type heat exchanger is mainly used to increase heat efficiency while required to have a reduced size.

FIG. 1 is a view showing an example of a conventional double pipe type heat exchanger, in which a hot water passage is formed inside of the heat exchanger and a heating water passage is formed outside of the heat exchanger.

Heat energy generated from a burner 10 is transferred to a hot water heat exchanging pipe 21 of the heat exchanger 20, and then heated water is discharged through a hot water pipe 32 to the outside of heat exchanger 20. Further, while heating rooms, a circulation pump 51 operates so that heating water receiving heat from hot water in the hot water heat exchanging pipe 21 to a heating water heat exchanging pipe 22 disposed in the hot water heat exchanging pipe 21 is supplied through an outlet 41 of the heating water heat exchanging pipe 22 to a place where heating is required so as to transfer heat thereto.

A reference numeral 11 which is not described above denotes a blower for blowing combustion heat of the burner 10 to the heat exchanger 20, and a reference numeral 31 indicates a cold water pipe in which a cold water is supplied to be heated as hot water. A reference numeral 42 refers to a heating water returning inlet through which the heating water returns after being discharged from the heating water outlet 41 and circulating heating pipes, and a reference numeral 50 denotes an expansion tank for removing air generated in the heating pipe, decreasing pressure which is caused in the pipe by expansion of the heating water according to increasing the temperature of the heating water, and regularly maintaining the amount of water in a boiler.

If a required heating temperature is high, the temperature of an outer heat exchanging pipe 21 becomes higher than the temperature of an inner heat exchanging pipe 22. When hot water is used during heating rooms at a relatively high temperature, the hot water is discharged from the outer heat exchanging pipe 21 of the heat exchanger 20. When high temperature hot water is discharged from the heat exchanger 20, there is a problem in that a user is exposed to a danger in scald.

DISCLOSURE OF INVENTION

Technical Problem

Accordingly, the present invention has been made to solve the above-mentioned problems occurring in the prior art, and it is an object of the present invention to provide a device for preventing initial hot water from being supplied from a double pipe heat exchanger and a method for controlling the same, which can mix cold water with initial hot water in order to prevent high temperature hot water from being supplied when a temperature for heating is set to be higher than a desired temperature, thereby removing danger in scald caused by discharge of hot water from a boiler.

Technical Solution

In order to accomplish the object of the present invention, according to an aspect of the present invention, there is provided a device for preventing initial hot water from being discharged from a double pipe heat exchanger which includes a cold water pipe into which a cold water is introduced, a hot water heat exchanging pipe for absorbing combustion heat of a burner so as to heat the cold water to hot water and to discharge the hot water, a hot water pipe for supplying high temperature hot water discharged from the hot water heat exchanging pipe, and a heating water heat exchanging pipe having both ends connected to a heating water returning inlet and a heating water discharging outlet and disposed in the hot water heat exchanging pipe, the device comprising: a bypass pipe extending between a cold water pipe and a hot water pipe, for directly supplying cold water in the cold water pipe to the hot water pipe; a mixing valve mounted on one end of the bypass pipe; a heating water temperature sensor mounted on the heat water discharging outlet, for detecting the heating water temperature; a hot water temperature sensor mounted on the hot water supplying pipe, for detecting a hot water temperature; and a controller for receiving temperature values detected by the heating water temperature sensor and the hot water temperature sensor so as to control a degree of opening of the mixing valve.

In order to accomplish the object of the present invention, according to another aspect of the present invention, there is provided a method of controlling a device for preventing initial hot water from being discharged from a double pipe heat exchanger, which comprises the steps of: controlling opening of a mixing valve by a controller in order to directly supply cold water to a hot water pipe; and closing the mixing valve so as to supply only the hot water in the hot water heat exchanging pipe to the hot water pipe when a heating water supplying temperature and a hot water temperature decrease below preset temperatures, respectively, if the controller detects the use of the hot water.

Advantageous Effects

The present invention can mix cold water with hot water at an initial time when hot water is used, and then can discharge mixed water so as to prevent scald due to initial hot water. When a temperature of hot water decreases to be lower than a preset temperature, the hot water heated by a burner is directly discharged, resulting in a supply of appropriate temperature hot water to a user.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a view showing a conventional double pipe heat exchanger;

FIG. 2 is a view showing a configuration of a double pipe heat exchanger according to the present invention; and FIG. 3 is a flowchart illustrating a method of controlling a device for preventing initial hot water from being discharged from the double pipe heat exchanger according to the present invention.

BEST MODE FOR CARRYING OUT THE INVENTION

Hereinafter, the preferred embodiment of the present invention will be described in detail with reference to the accompanying drawings.

FIG. 2 is view showing a configuration of the double pipe heat exchanger according to the present invention.

The structural elements of the double pipe heat exchanger according to the present invention having the same functions as those of the structural elements of the conventional double pipe heat exchanger in FIG. 1, are denoted by the same reference numeral, and the description thereof will be omitted to avoid duplicate description.

As shown in FIG. 2, a bypass pipe 60 is extended between a cold water pipe 31 and a hot water pipe 32, which is not heat-exchanged with combustion heat generated by a burner 10. A mixing valve 61 is mounted on the bypass pipe 60 to open and close fluid passage in the bypass pipe 60.

The mixing valve 61 is a value, a degree of opening which is adjusted based on a control signal of a controller 70.

A temperature sensor 23 for heating water and a temperature sensor 33 for hot water are respectively connected to an input end of the controller 70. The temperature sensors 23 and 33 respectively detect the temperature of the heating water supplied from the heating water heat exchanger 22 to the heating water outlet 41 and the temperature of the hot water supplied from the hot water heat exchanger 21 to the hot water pipe 32, so as to input temperature values into the controller 70.

The controller 70 controls overall operation of the boiler, and a degree of opening of the mixing valve 61 according to detected temperatures of the heating water temperature sensor 23 and the hot water temperature sensor 33. Especially, in order to implement the present invention, the mixing valve 61 is always open under a control of the controller 70. When the temperature of the heating water detected by the heating water temperature sensor 23 decreases below a preset temperature and the temperature of the hot water detected by the hot water temperature sensor 33 also decreases below a preset temperature, the mixing valve 61 is closed under a control of the controller.

Specifically, when the mixing valve 61 is open, cold water is introduced into the hot water pipe 32 through the cold water pipe 31 and the bypass pipe 60, so that the hot water is mixed with the cold water. Hence, even though a user opens a hot water switch, the initially high temperature water is not discharged. When the mixing valve 61 is closed, the introduction of a low temperature cold water flowing along the cold water pipe 31 into the hot water pipe 32 is interrupted, so that the user can use the hot water with appropriate temperature instead of a low temperature water.

As described above, it is obvious that a diameter of the bypass pipe 60 connecting the cold water pipe 31 to the hot water pipe 32 is designed so that the amount of cold water enough to cool the hot water in the heat exchanger 20 can flow through the bypass pipe 60.

Further, in the embodiment of the present invention, a mixing on/off valve or a mixing fluid control valve may be used as the mixing valve. However, the present invention is not limited to the above-mentioned valves, and other valves can be available if the degree of the valves can be adjusted.

FIG. 3 is a flowchart illustrating a method of controlling a device for preventing initial hot water from being supplied from the double pipe heat exchanger according to the present invention.

The controller 70 maintains the open state of the mixing valve 61 at an initial operation of the boiler. Thus, an open valve is preferably used as the mixing valve 61.

When a flow switch 34, etc. mounted on the boiler detects the use of hot water and inputs the detected signal into the controller 70, the controller 70 checks a temperature of heating water detected by the heating water temperature sensor 3 mounted on the heating water pipe of the heating water outlet 41.

When the heating water temperature is no lower than a preset temperature Ts (for example, 60 celsius degrees), the controller determines that the temperature of discharged hot water is very high and continues to keep the mixing valve 61 in the open state. The temperature Ts is set in advance in order to continuously keep the mixing valve 61 in the open state, so that cold water is mixed with the hot water supplied to the outside through the hot water pipe 32 to decrease the temperature of the hot water in expectation that the hot water has a high enough temperature to scald a user. The temperature Ts can be changed in scope of the present invention without departing from the gist of the present invention.

Then, when the controller 70 detects that the heating water temperature is no higher than the temperature Ts, the controller 70 receives and checks the detected temperature of the hot water temperature sensor 33 mounted on the hot water pipe 32. At this time, when the hot water temperature is no lower than a preset temperature Tw (for example, 50 Celsius degrees), the controller determines that the temperature of the discharged hot water is still high, and keeps the mixing valve 61 in the open state. The preset temperature Tw is set in advance in order to continuously keep the mixing valve 61 in the open state, so that cold water is mixed with the hot water supplied to the outside through the hot water pipe 32 to decrease the temperature of the hot water in expectation that the hot water has a high enough temperature to scald a user. The temperature Ts can be changed in scope of the present invention without departing from the gist of the present invention.

When time lapses after use of the hot water, the high temperature hot water in the outer hot water heat exchanger 21 of the heat exchanger 20 is all discharged. While passing through the heat exchanger 20, the cold water absorbs the combustion heat of the burner 10 so as to be heated to the hot water, and then is discharged. At this time, since the cold water may be discharged before being heated to the high temperature hot water according to the amount of hot water to be used, the temperature of the heating water detected by the heating water temperature sensor 23 decreases below the preset temperature Ts, and the temperature of the hot water detected by the hot water sensor 33 decreases below the preset temperature Tw. Hence, the controller 70 closes the mixing valve 61 so as to prevent the cold water from being mixed with the hot water.

Then, the controller 70 performs a general operation of controlling a temperature of the hot water according to a hot water control algorithm.

In addition, if the hot water is not used for a long time, the temperature of the heating water and the temperature of the hot water are higher than the set temperatures Ts and Tw, so that the control operation is repeated.

INDUSTRIAL APPLICABILITY

As described above, the present invention can be applied to a device for preventing initial hot water from being discharged from a double pipe heat exchanger, mixes and discharges the hot water with cold water at an initial time when the hot water is used, thereby preventing scald due to the initial hot water. When the temperature of the hot water decreases below a preset temperature, the hot water heated by the burner is directly discharged. Accordingly, it is possible to supply appropriate hot water to a user.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A device for preventing initial hot water from being discharged from a double pipe heat exchanger which includes a cold water pipe into which a cold water is introduced, a hot water heat exchanging pipe for absorbing combustion heat of a burner so as to heat the cold water to hot water and to discharge the hot water, a hot water pipe for supplying high temperature hot water discharged from the hot water heat exchanging pipe, and a heating water heat exchanging pipe having both ends connected to a heating water returning inlet and a heating water discharging outlet and disposed in the hot water heat exchanging pipe, the device comprising:

a bypass pipe extending between the cold water pipe and the hot water pipe, for directly supplying cold water in the cold water pipe to the hot water pipe;

a mixing valve coupled to the bypass pipe;

a heating water temperature sensor coupled to the heating water discharging outlet, for detecting a temperature of the heating water;

a hot water temperature sensor coupled to the hot water pipe, for detecting a temperature of the hot water; and a controller configured to control the mixing valve by opening and closing the mixing valve, wherein the controller closes the mixing valve when the temperature of the heating water detected by the heating water temperature sensor is below a first preset temperature and when the temperature of the hot water detected by the hot water temperature sensor is below a second preset temperature.

2. The device as claimed in claim 1, wherein the mixing valve is a normally opened valve.

3. A method of controlling a device for preventing initial hot water from being discharged from a double pipe heat exchanger, the method comprising the steps of:

controlling opening of a mixing valve by a controller in order to directly supply cold water to a hot water pipe; and closing the mixing valve so as to supply only the hot water in the hot water heat exchanging pipe to the hot water pipe when the temperature of the heating water detected by the heating water temperature sensor decreases below a first preset temperature and thereafter the temperature of the hot water detected by the hot water temperature sensor also decreases below a second preset temperature, if the controller detects the use of the hot water.

* * * * *